United States Patent [19]

Cavallaro et al.

[11] Patent Number: 5,008,681

[45] Date of Patent: Apr. 16, 1991

[54] MICROSTRIP ANTENNA WITH PARASITIC ELEMENTS

[75] Inventors: Nunzio M. Cavallaro, Methuen; John F. Toth, Reading; Cleo J. Alexander, Marlborough, all of Mass.

[73] Assignee: Raytheon Company, Lexington, Mass.

[21] Appl. No.: 536,043

[22] Filed: Jun. 8, 1990

Related U.S. Application Data

[63] Continuation of Ser. No. 332,145, Apr. 3, 1989, abandoned.

[51] Int. Cl.[5] ..... H01Q 1/380; H01Q 13/080; H01Q 19/300

[52] U.S. Cl. ..... 343/700 MS; 343/819

[58] Field of Search ..... 343/700 MS, 705, 708, 343/815-820, 833, 834

[56] References Cited

U.S. PATENT DOCUMENTS

| | | | |
|---|---|---|---|
| 3,577,196 | 5/1971 | Pereoa | 343/770 |
| 3,713,162 | 1/1973 | Munson et al. | 343/705 |
| 3,978,487 | 8/1976 | Kaloi | 343/700 MS File |
| 4,304,603 | 12/1981 | Grossman et al. | 501/9 |
| 4,370,657 | 1/1983 | Kaloi | 343/700 MS File |
| 4,378,558 | 3/1983 | Lunden | 343/814 |
| 4,384,290 | 5/1983 | Pierrot et al. | 343/854 |
| 4,812,855 | 3/1989 | Coe et al. | 343/700 MS File |

FOREIGN PATENT DOCUMENTS

| | | | |
|---|---|---|---|
| 0655846 | 1/1963 | Canada | 343/705 |
| 2138384 | 2/1973 | Fed. Rep. of Germany | 342/792.5 |
| 0276903 | 11/1988 | Japan . | |

OTHER PUBLICATIONS

Rana et al., Theory of Microstrip Yagi-uda arrays, Radio Science, vol. 16, No. 6, pp. 1077-1079, Nov.-Dec. 1981.

Lee et al., Microstrip Antenna Array with Parasitic Elements, IEEE APS Symposium Digest, Jun. 1987, pp. 794-797.

Huang, Planar Microstrip Yagi Array Antenna, Int. Symp. Digest Antennas and Propacation, Jun. 26-30, 1989, pp. 894-897.

*Primary Examiner*—Michael C. Wimer

*Assistant Examiner*—Peter Toby Brown

*Attorney, Agent, or Firm*—Donald F. Mofford; Richard M. Sharkansky

[57] ABSTRACT

In a guided missile, a microstrip antenna, including a patch radiator with parasitic elements, flush-mounted and conforming to the side of the missile, producing an antenna beam which is tilted in required direction for use as a link or fuse antenna is shown. Parasitic elements are used to direct the beam away from the antenna normal to the desired direction.

6 Claims, 2 Drawing Sheets

MICROSTRIP ANTENNA WITH PARASITIC ELEMENTS

This invention was made with Government support under Contract No. DAAH01-85-C-A045 awarded by the Department of the Army. The Government has certain rights in this invention.

This application is a continuation of application Ser. No. 332,145 filed Apr. 3, 1989.

BACKGROUND OF THE INVENTION

This invention pertains generally to antennas for radio frequency energy, and more particularly to directional antennas wherein parasitic elements are used to control the direction of a beam from an antenna.

In guided missile (or simply missile) applications, fuse and link antennas often are required to be mounted conformally with the generally cylindrical shape of a missile. Antennas which adapt easily to conformal mounting usually produce beams with main lobes directed normally (or broadside to) the missile, whereas the required direction of main lobes of beams for fuse and link antennas is usually not normal (or broadside) to the missile. Thus, the main lobes of fuse antenna beams are typically pointed forward of the missile, while the main lobes of link antenna beams are usually pointed aft, say in a beam direction approximately twenty degrees off of normal. To accomplish such an end, known link antennas are usually made of components that occupy critical area internally of the missile. The mass and volume of all components within the missile are critical to performance, and any decrease in the size and number of components is highly desirable.

It is known in the art that microstrip patch antennas have a low profile and may be made conformal to a missile. Unfortunately, most patch antennas produce an antenna beam normally disposed to the aperture of the antenna. Different approaches have been used to change the antenna beam direction. Multiple patch antenna arrays have been used to steer the antenna beam direction. Such arrays have been built by using a stripline distribution network; however, such a network is complicated, with many connections required. A less complicated technique is desirable.

It is also known in the art that parasitic elements may be used to control the direction of the beam of an antenna. For example, the well-known 'Yagi' antenna uses parasitic elements in combination with at least one active element to control the direction of a beam. A similar technique is known for use with parasitic slot array antennas, as described in an article by R. J. Coe and G. Held, I.E.E.E. Transactions on Antennas and Propagation, Vol. Ap-12, No. 1, pp. 10–16, January 1964. In such an array, a reflector element and a director element are formed by cavity-tuned parasitic slots so that when a driven element (a slot) is excited, a beam is formed in the direction of the director in the plane of the elements. The parasitic slot array provides a flush mounting antenna suitable for an application where no projection above a plane surface is required. However, as noted previously, a fuse or link antenna usually requires an antenna beam direction approximately twenty degrees off of normal or broadside of the face of the antenna so the parasitic slot array is hardly one to be used in a missile.

SUMMARY OF THE INVENTION

Therefore, it is a primary object of this invention to provide an improved antenna which has a beam with a main lobe tilted approximately twenty degrees from a normal to a missile, such while retaining the low profile, low volume attributes.

Another object of this invention is to provide an improved antenna which is readily adaptable to flush-mounting on a missile.

These and other objects of this invention are attained generally by providing a microstrip patch antenna with parasitic elements flush-mounted to the side of a missile to produce an antenna beam with a main lobe directed approximately twenty degrees off of the normal to the missile, such antenna here including a driven patch antenna, a reflector element and two director elements, with the reflector and director elements being parasitic elements in combination with appropriate connector elements.

BRIEF DESCRIPTION OF THE DRAWINGS

For a more complete understanding of this invention, reference is now made to the following description of the accompanying drawings, wherein.

DESCRIPTION OF THE PREFERRED EMBODIMENT

Figure 1:
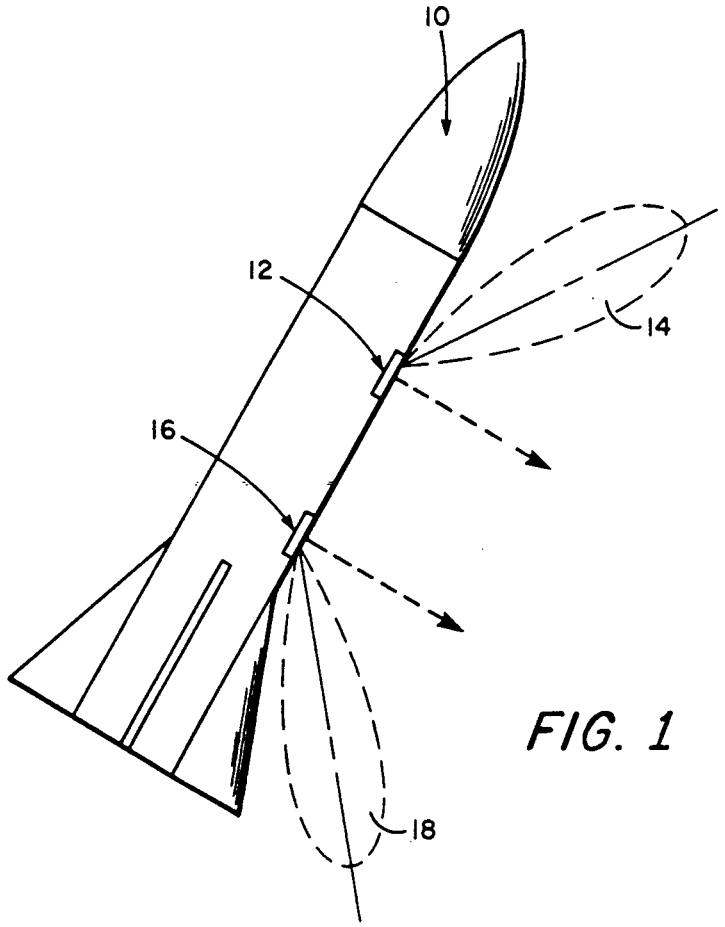
FIG. 1 is a sketch showing generally the contemplated location of the microstrip antenna and the direction of the antenna beams.

Referring now to FIG. 1, a missile 10, here a semi-active missile, is shown to include a fuse antenna 12 and a link antenna 16. It is well known in the art that the main lobe of the beam from fuse antenna 12 must typically point forward from a normal to the missile 10 as illustrated by beam 14 because any target (not shown) would be ahead of the missile 10. In contrast, the main lobe of a link antenna 16 must typically point aft of a normal as illustrated by beam 18 because signals to (or from) the link antenna 16 come from (or are directed to) a station (not shown) located to the rear of missile 10.

Figure 2:
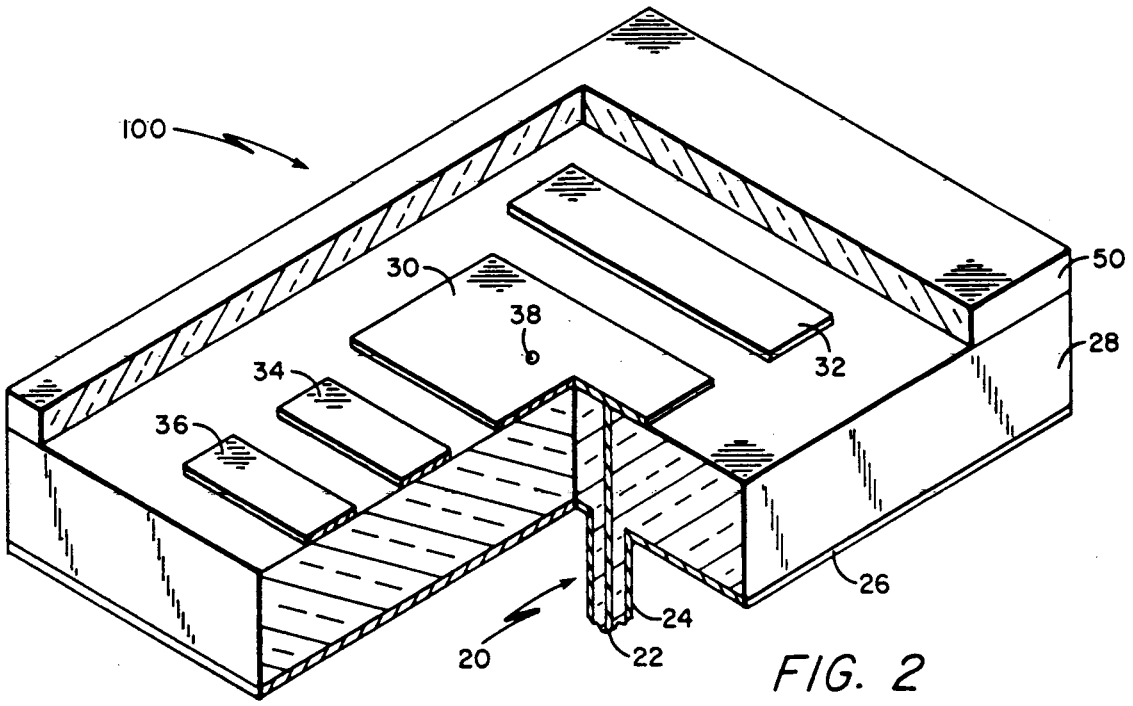
FIG. 2 is a sketch showing an isometric view, partially cut away for clarity of illustration, of the microstrip antenna according to the invention.

Referring now to FIG. 2, a microstrip antenna 100 as here contemplated is shown to include antenna elements 30,32,34,36 disposed on a slab 28 fabricated from a dielectric material. Such dielectric material may, for example, be the material known as 'Duriod,' or other Teflon-fiberglass material. The antenna elements 30,32, 34,36 are formed by depositing an electrically conducting material (here copper) in any conventional manner as shown on the slab 28. The second side of slab 28 is covered with an electrically conductive coating to form a metallic ground plane 26. The antenna elements 30,32,34,36 are arranged in an array where a driven element (herein also referred to as 'patch 30') here is the second antenna element from the right. It will be observed that the patch 30, when actuated by itself, is operative to form a beam by reason of fringing fields around the periphery of such patch and that the main lobe of such beam is broadside to such patch. Further, it will be observed that the patch 30, when matched to a feed, is effectively equivalent to a resonant cavity. A shorting pin 38 in electrical contact centrally of the patch 30 is passed through the slab 28 to be attached to ground plane 26. The shorting pin 38 has no effect on radiation or impedance of the antenna being described, but simply allows a low frequency path between the patch 30 and the ground plane 26. The patch 30 here is fed by a coaxial line 20 affixed to the ground plane 26. Thus, an outer shield 24 of the coaxial line 20 is attached in any known fashion to ground plane 26. A center conductor 22 of the coaxial line 20 is attached to the patch 30 in any known fashion. Although the location of the point of connection between the patch 30 and the center conductor 22 does not affect the frequency of resonance, such location does affect input impedance of the antenna being described, so care should be taken to provide a proper impedance match with the impedance of the coaxial line 20. A reflector element 32, a first director element 34 and a second director element 36 make up the parasitic elements of the microstrip antenna 100. The parasitic elements are here effective to cause the direction of the main lobe in the beam radiated by the patch 30 to be changed as desired.

Parasitic elements are inactive elements, meaning not fed or driven with a signal, placed on the face of the microstrip antenna 100 in close proximity to the patch 30. The advantage of this approach is that the direction of the main lobe in the beam may be changed without the penalty of beam narrowing associated with antenna feed networks. By varying the length, width, location and number of the parasitic elements, the direction of the main lobe in the beam is changed as required from the normal. There are two types of parasitic elements, a director type element and a reflector type element. The length of the parasitic element with respect to the narrow edge of the patch 30 determines the type of element, where shorter elements act as directors, while longer elements act as reflectors. Reflector element 32, here a parasitic element of the reflector type, tips the beam (not shown) away from the parasitic element. Director elements 34, 36, respectively, here parasitic elements of the director type, tip the beam (not shown) in the direction of the parasitic elements. The presence of the parasitic elements affects the impedance matching of the patch 30. A resulting mismatch of impedance can be compensated for by retuning the patch 30 with the parasitic elements present. This is easily accomplished either by changing the dimensions of the patch 30, or adjusting the location of the feed point. In connection with the latter method of adjustment, it will be noted that the feed point, i.e., the point at which the center conductor 22 is attached to the patch 30, is on a centerline of the patch 30. However the feed point is adjusted, the point of attachment should remain on that centerline.

A high thermal protection window 50 (hereinafter also referred to as 'window 50') is attached to the missile 10 to overlie the slab 28 and antenna elements 30,32,34,36 when the microstrip antenna 100 is mounted on missile 10 (FIG. 1). The window 50 here is a ceramic, rigid, composite-fiber, insulation material, known as 'HTP 12-22,' developed by Lockheed Missiles and Space Company, Inc., Sunnyvale, Calif. HTP 12-22 provides good thermal shock resistance, low thermal conductivity, good strength and low dielectric constant for the window 50. The window 50 protects the microstrip antenna 100 from a harsh environment experienced while missile 10 (FIG. 1) is in flight. For further protection the window 50 may be treated with a silane polymer solution for moisture-proofing and an external reaction-cured glass-based coating for increased surface toughness and crack propagation resistance.

Figure 3:
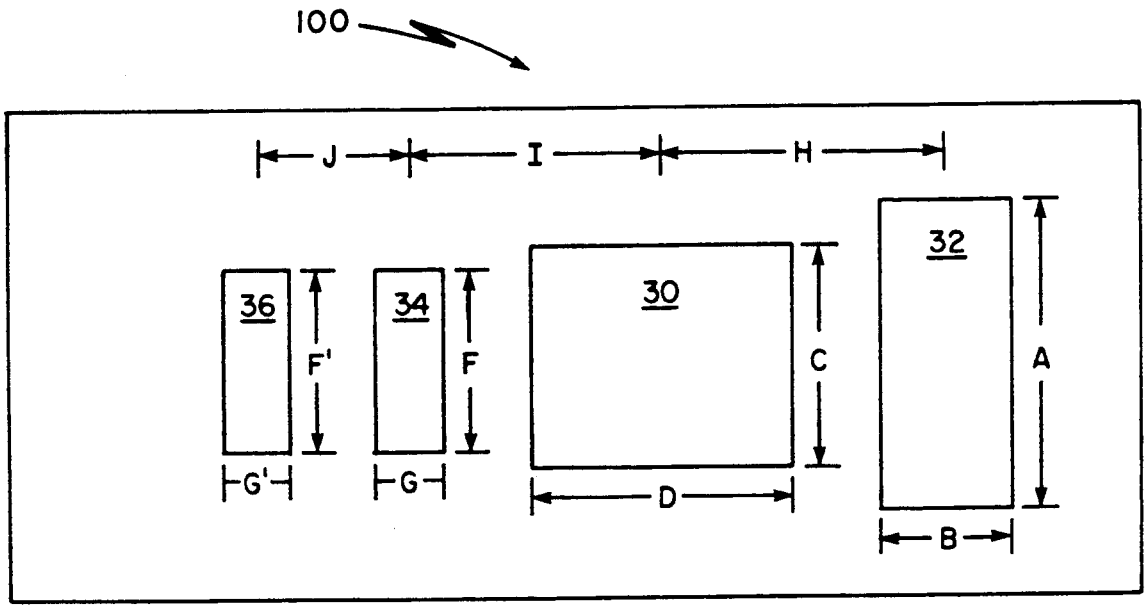
FIG. 3 is a plan view of the microstrip antenna according to the invention.

Referring now to FIG. 3, a plan view of the microstrip antenna 100 is shown. It can be seen that patch 30 has a width C and a length D. Patch 30 is constructed such that the width C is equal in wavelength 'L' to 0.380L and the length D is equal to 0.494L. Reflector element 32 has a width A and a length B. Reflector element 32 is constructed such that the width A is equal to 0.494L and the length B is equal to 0.304L. It should be noted that the center of reflector element 32 is separated from the center of patch 30 by the distance H which is equal to 0.570L. Microstrip antenna 100 also includes director element 34 and director element 36. Director element 34 has a width F and a length G. Director element 34 is constructed such that the width F is equal to 0.266L and the length G is equal to 0.114L. The center of director element 34 is separated from the center of patch 30 by the distance I which is equal to 0.456L. Director element 36 has a width F' and a length G'. Director element 36 is constructed such that the width F' is equal to 0.266L and the length G' is equal to 0.114L. The center of director element 34 is separated from the center of director element 36 by the distance J which is equal to 0.228L.

Having described this invention, it will now be apparent to one of skill in the art that the number and disposition of the parasitic elements may be changed without affecting this invention. For example, the number of director elements could be reduced to one or increased to three, thus further controlling the desired direction of the beam. It is felt, therefore, that this invention should not be restricted to its disclosed embodiment, but rather should be limited only by the spirit and scope of the appended claims.

What is claimed is:

1.

An antenna comprising:

(a) means for providing a beam of radio frequency (RF) energy comprising:

(i) a dielectric having a first surface and a second surface; the first surface providing a reference plane;

(ii) a patch radiator disposed on the first surface, said patch radiator having length and width dimensions between 0.3 and 0.5 wavelengths; of said RF energy; and (iii) an electrically conductive coating disposed on the second surface; and (b) means for directing the beam of radio frequency energy toward a direction approximately twenty degrees from a normal to the reference plane, said directing means comprising a plurality of parasitic antenna elements disposed on the first surface, each of said parasitic antenna elements having dimensions differing from corresponding dimensions of the patch radiator, (i) with a first portion of said plurality of parasitic antenna elements being disposed on one side of the patch radiator, and each one being a reflector element with the dimension of the side nearest to the patch radiator being greater than the corresponding dimension of the patch radiator, said reflector element having a width equal to 0.494L and a length equal to 0.304L, where L is substantially the wavelength of the radio frequency energy, and said patch radiator having a width equal to 0.380L and a length equal to 0.494L, the center of said patch radiator separated from the center of said reflector element by 0.570L; and (ii) with a second different portion of said plurality of parasitic antenna elements being disposed on the other side of the patch radiator, and each one being a director element with the dimension of the side nearest to the patch radiator being less than the corresponding dimension of the patch radiator, said director element having a width equal to 0.266L and a length equal to 0.114L, the center of each director element separated from the center of an adjacent director element by 0.228L and the center of the director element adjacent the patch radiator separated from the center of the patch radiator by 0.456L.

2. A microstrip antenna as in claim 1 having, additionally, a high thermal protection window attached to the first surface of the slab.

3. A microstrip antenna as in claim 2 having, additionally, means for mounting the slab, including the patch radiator and the parasitic elements, and the high thermal protection window in an opening formed in the guided missile to permit radiation through such opening.

4. An antenna comprising:

(a) a dielectric having a first surface and a second surface;

(b) a patch radiator disposed on the first surface of the dielectric, the patch radiator having a center and a width about 0.380 of a wavelength of radio frequency energy propagating therein and a length about 0.494 of a wavelength of the radio frequency energy;

(c) an electrically conductive coating disposed on the second surface; and (d) means for providing a beam of radio frequency energy in a direction oblique to the first surface comprising a plurality of parasitic elements disposed in an array along a first director on the first surface, each of said parasitic antenna elements being a strip of electrically conductive material with width dimensions disposed orthogonal to the first direction and differing from the width dimensions of the patch radiator, said providing means comprising:

(i) a reflector element having a center and a width about 0.494 of a wavelength of the radio frequency energy and a length about 0.304 of a wavelength of the radio frequency energy, the center of the reflector element disposed about 0.570 of a wavelength of the radio frequency energy from the center of the patch radiator; and a plurality of director elements, each director element having a center and a width about 0.266 of a wavelength of the radio frequency energy and a length about 0.114 of a wavelength of the radio frequency energy, the center of each director element disposed about 0.228 of a wavelength of the radio frequency energy from the center of an adjacent director element and the center of the director element adjacent the patch radiator disposed about 0.456 of a wavelength of the radio frequency energy from the center of the patch radiator.

5. An antenna comprising:

a plurality of elements disposed along a first direction in an array, each one of the plurality of elements having a center, a width and a length, the length of each one of the plurality disposed in a direction along the first direction and the width of each one of the plurality of elements disposed in a direction orthogonal to the first direction, the plurality of elements comprising:

(a) a patch radiator element having a width approximately 0.380 of a wavelength of radio frequency (RF) energy propagating therein and a length approximately 0.494 of a wavelength of the RF energy;

(b) a reflector element having a width approximately 0.494 of a wavelength of the RF energy and a length approximately 0.304 of a wavelength of the RF energy, the center of the reflector element disposed approximately 0.570 of a wavelength of the RF energy from the center of the patch radiator element, and (c) a director element having a width approximately 0.266 of a wavelength of the RF energy and a length of 0.114 of a wavelength of the RF energy, the center of the director element disposed approximately 0.456 of a wavelength of the RF energy from the center of the patch radiator element.

6. The antenna as recited in claim 5 wherein the plurality of elements further comprises a second director element having a width approximately 0.266 of a wavelength of the RF energy and a length of 0.114 of a wavelength of the RF energy, the center of the second director element disposed approximately 0.228 of a wavelength of the RF energy from the center of the director element.

* * * * *